US007167510B2

(12) United States Patent
Horst et al.

(10) Patent No.: US 7,167,510 B2
(45) Date of Patent: Jan. 23, 2007

(54) METHOD AND APPARATUS FOR ASSIGNING ADDRESSES TO COMPONENTS IN A CONTROL SYSTEM

(75) Inventors: Folkert Horst, Pierrefonds (CA); André Brousseau, Châteauguay (CA); Oleh Szklar, St. Hubert (CA); Luc Ethier, St-Eustache (CA)

(73) Assignee: Cattron Intellectual Property Corporation, Sharpville, PA (US)

( * ) Notice: Subject to any disclaimer, the term of this patent is extended or adjusted under 35 U.S.C. 154(b) by 0 days.

(21) Appl. No.: 09/281,464

(22) Filed: Mar. 30, 1999

(65) Prior Publication Data

US 2003/0198298 A1 Oct. 23, 2003

(30) Foreign Application Priority Data

Mar. 25, 1999 (CA) ..... 2266998

(51) Int. Cl.
*H04B 1/38* (2006.01)
*H04L 5/16* (2006.01)

(52) U.S. Cl. ..... 375/222; 375/219; 701/19; 359/145

(58) Field of Classification Search ..... 375/259, 375/219, 220, 222; 701/19, 20; 340/5.5, 825.69; 359/154, 142, 144, 145
See application file for complete search history.

(56) References Cited

U.S. PATENT DOCUMENTS 3,639,755 A 2/1972 Wrege ..... 246/187 B
4,245,347 A 1/1981 Hutton et al. ..... 455/70
4,264,954 A * 4/1981 Briggs et al. ..... 710/4

(Continued)

FOREIGN PATENT DOCUMENTS

| | | |
|---|---|---|
| DE | 36 18 464 A1 | 12/1987 |
| DE | 42 42 231 | 12/1992 |
| DE | 42 42 231 A1 | 6/1994 |
| EP | 0 326 630 | 8/1989 |
| EP | 0 704 590 A2 | 3/1996 |
| EP | 0 704 590 A3 | 3/1996 |
| EP | 0 704 590 | 4/1996 |
| WO | WO 96/36953 | 11/1996 |

OTHER PUBLICATIONS

Sklar, "Digital Communications Fundamentals and Applications", 1988, published by Prentice Hall Inc., pages 4, 5, 51 and 78–81.*
Delcaration of Folkert Horst dated Jun. 18, 2004.
Theimeg Facsimile dated Mar. 21, 2004.
Theimeg Fasimile dated Apr. 30, 1993.
Sklar, *Digital Communications Fundamentals and Applications,* 1988.

(Continued)

*Primary Examiner*—Phuong Phu
(74) *Attorney, Agent, or Firm*—Merchant & Gould P.C.

(57) ABSTRACT

The invention relates to a method and an apparatus for remotely controlling device, more particularly to a system and method for controlling locomotives in a railway environment using radio frequency signals. This invention makes use of a remote operator programming unit (OPP) to set address information in the transmitter unit via a communication channel such as an infrared link. The use of the operator programming unit allows eliminating the need to open the casing of the transmitter during programming thereby reducing the probability of damaging the electrical components of the transmitter. The invention also allows assigning a unique address to a transmitter/receiver pair in a remote control system. The invention further provides an apparatus for remotely programming a transmitter unit.

94 Claims, 6 Drawing Sheets

U.S. PATENT DOCUMENTS

| | | | | | |
|---|---|---|---|---|---|
| 4,529,980 | A | | 7/1985 | Liotine et al. | |
| 4,553,723 | A | | 11/1985 | Nichols et al. | |
| 4,582,280 | A | | 4/1986 | Nichols et al. | |
| 4,687,258 | A | | 8/1987 | Astley | |
| 4,912,463 | A | | 3/1990 | Li | |
| 5,039,038 | A | | 8/1991 | Nichols et al. | |
| 5,122,948 | A | | 6/1992 | Zapolin | |
| 5,495,520 | A | | 2/1996 | Kojima | |
| 5,511,749 | A | | 4/1996 | Horst et al. | |
| 5,533,695 | A | * | 7/1996 | Heggestad et al. | 246/62 |
| 5,570,284 | A | | 10/1996 | Roselli et al. | |
| 5,681,015 | A | | 10/1997 | Kull | |
| 5,685,507 | A | * | 11/1997 | Horst et al. | 246/187 A |
| 5,729,210 | A | * | 3/1998 | Kiriyama | 340/825.72 |
| 5,746,261 | A | | 5/1998 | Bowling | |
| 5,815,823 | A | | 9/1998 | Engle | |
| 5,884,146 | A | | 3/1999 | Simmons | 455/66 |
| 6,218,961 | B1 | | 4/2001 | Gross et al. | |
| 6,275,739 | B1 | | 8/2001 | Ireland | |
| 6,314,345 | B1 | | 11/2001 | Coombes | |
| 6,400,281 | B1 | * | 6/2002 | Darby, Jr. et al. | 340/933 |
| 6,449,536 | B1 | * | 9/2002 | Brousseau et al. | 701/19 |
| 6,456,674 | B1 | | 9/2002 | Horst et al. | |
| 6,466,847 | B1 | | 10/2002 | Horst | |
| 6,470,245 | B1 | | 10/2002 | Proulx | |

OTHER PUBLICATIONS

Search Report entitled: "Remote Control Systems for Locomorives: Review of Technical and Trade Literature, 1980 Forward" Compiled by Information Works Inc. for Lauric Mitchell, CANAC, Inc. May 20, 2003 p. 1–110, bibliography.

European Search Report dated Jul. 28, 2003.

* cited by examiner

METHOD AND APPARATUS FOR ASSIGNING ADDRESSES TO COMPONENTS IN A CONTROL SYSTEM

This application claims priority under 35 USC 119 to Canadian Application "Method and Apparatus for Assigning Addresses to Components in a Control System," (serial number not yet assigned), filed Mar. 25, 1999, which is incorporated by reference herein.

1. Field of the invention

This Invention relates to the field of communication and control systems. It is particularly applicable to a method and apparatus for assigning machine addresses to computer or electronically controlled devices, and may be used to assign machine addresses to a control system using radio communication to transmit commands between a master controller and a slave controller.

2. Background of the invention

Electronic controllers are commonly used in the industry to regulate the operation of a wide variety of systems. In a specific example, electronic controllers are used to control remotely vehicles such as locomotives in order to perform functions including braking, traction control and acceleration without the necessity of a human operator on board the locomotive. Radio frequency transmitter-receiver pairs are of particular interest for remotely controlling such vehicles.

In a typical locomotive control system, the operator communicates with a slave controller onboard the locomotive using a remote control device, herein designated as transmitter. The transmitter includes an electronic circuit placed in a suitable casing that provides mechanical protection to the electronic components.

In use the operator of the locomotive enters requests into the transmitter via an input means such as a keyboard, touch screen or any other suitable input means. Typical requests may include brake, accelerate and any function that a locomotive may be required to perform. The transmitter encodes the request into a form suitable for transmission over a pre-determined frequency link. Usually, a tag is appended to the request containing an identifier, herein designated as an address, unique to the remote control transmitter from which the request originates. The complete request is then modulated at the pre-determined radio frequency and transmitted as a RF signal. Frequencies other than RF have also been used for this purpose.

Commonly, many transmitters may operate on the same radio frequency channel or on overlapping radio frequency channels often resulting in interference between the various signals. Signals transmitted in overlapping frequency channels cannot be resolved into their respective signals by the slave controller. The interference of the signals typically causes requests to be lost. Consequently, a request is often transmitted continuously at a given repetition rate and each transmitter is assigned a unique repetition rate. The unique repetition rate reduces the likelihood of messages interfering with one another. Many methods of assigning transmission rates are well known in the art to which this invention pertains. For an example of a method of assigning a repetition rate, the reader may refer to U.S. Pat. No. 4,245,347 by Hutton et al. whose content is hereby incorporated by reference.

Optionally, once the transmitter sends the RF signal, a repeater unit may receive the RF signal. Typical repeater units are ground-based units whose function is to extend the radio frequency (RF) range of the transmitter of the remote control device by amplifying the signal and filtering noise components. Repeater units are well-known in the art to which this invention pertains and typically comprise an RF antenna, an RF receiver, a decoder/encoder, an RF re-transmitter and any other equipment such as filters, duplexors and others required to receive a signal, process it and retransmit it. Commonly, the repeater unit re-transmits the signal at a frequency different from the frequency used by the transmitter as well as sufficiently spaced in frequency from the frequency used by the transmitter such that the two signals can be resolved if they are received simultaneously by a receiver unit.

The slave controller onboard the locomotive receives and demodulates the RF signal originating from the transmitter or from the repeater unit. The signal is then decoded and the validity of the request is verified. The slave controller stores an identifier indicative of the machine address of the transmitter assigned to the locomotive. The identifier is compared to the tag contained in the received demodulated request. Another operation in the verification of the signal involves verifying if the signal is intact by using a check sum or other suitable error detection or correction algorithm. If the signal is valid it is then processed further so the command contained in the request can be implemented.

Locomotive control systems of the type described above require the involvement of a human administrator that assigns and keeps a record of the various machine addresses of the transmitters in use. Generally, to assign an address to a transmitter or to a slave controller, dip switches within the transmitter and the slave controller are physically set. The position of the dip switches defines the machine address assigned to the transmitter. Similarly, at the slave controller, dip switches are provided to define the address of the transmitter permitted to communicate with the receiver. Occasionally, such transmitters/receivers need to be replaced or temporarily removed from service to perform maintenance. For instance, in order to assign an address to a new transmitter module, the casing of the transmitter must be opened and the dipswitches must be correctly set by the human operator. The setting is such that the machine address of the previous transmitter is duplicated on the new unit so the latter can communicate with the slave controller in the field.

The first problem with transmitter units of the type described above is the requirement to open the transmitter casing in order to access the dip switches. Such an operation, unless performed carefully can compromise the integrity of the casing. For example, if the casing is waterproof, opening it may damage the watertight seal, thus increasing the risk of premature component failure.

The second problem with transmitter units of the type described above is the high reliance upon a technician to physically set the machine address by manipulating the dip switches. The reliance on an operator to assign addresses makes the system highly susceptible to human errors. For example, a technician may erroneously give two transmitter units the same machine address resulting in conflicting signals by setting the dipswitches in the inappropriate position. Finally, a human operator is required to assign and manage the addresses of the transmitters in order to insure that no two transmitters are given the same address. Consequently, the assignment and management of addresses by an operator is a Lime consuming task resulting in significant labour costs.

Thus, there exists a need in the industry to refine the process of assigning a machine address to a component of a control system such as to maintain the integrity of the components, to reduce the possibility of human error and to reduce the involvement of a human operator for the management of the addresses.

SUMMARY OF THE INVENTION

For the purpose of this specification, the expressions "random" and "substantially random" are used to define a numerical pattern with very low correlation between its composing elements. In computer applications, random numbers are often generated using a mathematical formula that attempts to approach the "purely random" behaviour. However, in the context of this specification this expression should be given a broad interpretation to mean any non-numerically organised sequence of numbers or any other characters or symbols.

The present invention provides a novel operator programming unit allowing performing address synchronisation between a transmitter and a slave controller, particularly in the context of remote controlled system. The transmitter and the slave controller are assigned identical addresses. When the transmitter issues a command, the address is embedded in the signal. The slave controller receives the signal and will process it only when the embedded address matches the locally stored address information. This feature constrains the slave controller to accept commands only from designated transmitters.

The address has two parts. One part is an Identifier of the transmitter, the other part is an identifier from the slave controller. When these two parts are assembled, the combination forms a unique address for the pair transmitter/slave controller.

The operator programming unit is designed to communicate with one of the devices, say the slave controller to gather its identifier. Next, the operator programming unit communicates with the other device, say the transmitter to transmit to it the identifier of the slave controller. Preferably, at the same time the operator programming unit gathers the identifier of the transmitter. Finally, the operator programming unit then communicates with the slave controller to communicate to it the identifier of the transmitter. This procedure allows effecting an identifier exchange between the devices such that they all posses the same parts of the address. Accordingly, both the transmitter and the slave controller will have the same address information allowing interoperability to take place. In addition, by automatically assigning unique identifiers to transmitters and slave controllers, a one-to-one correspondence between selected transmitter-slave pairs can be achieved.

The invention also provides a novel transmitter for use in a remote control system featuring a dual part address, one part being proper to the transmitter and one part being proper to a slave controller to which the transmitter issues commands.

The invention yet provides a novel slave controller for use in a remote control system featuring a dual part address, one part being proper to the slave controller and one part being proper to transmitter that issues commands to the slave controller.

Finally, the invention also provides a novel remote control system including a transmitter and a slave controller, the system using a dual part address to effect command validation.

BRIEF DESCRIPTION OF THE DRAWINGS

These and other features of the present invention will become apparent from the following detailed description considered in connection with the accompanying drawings. It is to be understood, however, that the drawings are provided for purposes of illustration only and not as a definition of the boundaries of the invention for which reference should be made to the appending claims.

DESCRIPTION OF A PREFERRED EMBODIMENT

Figure 1:
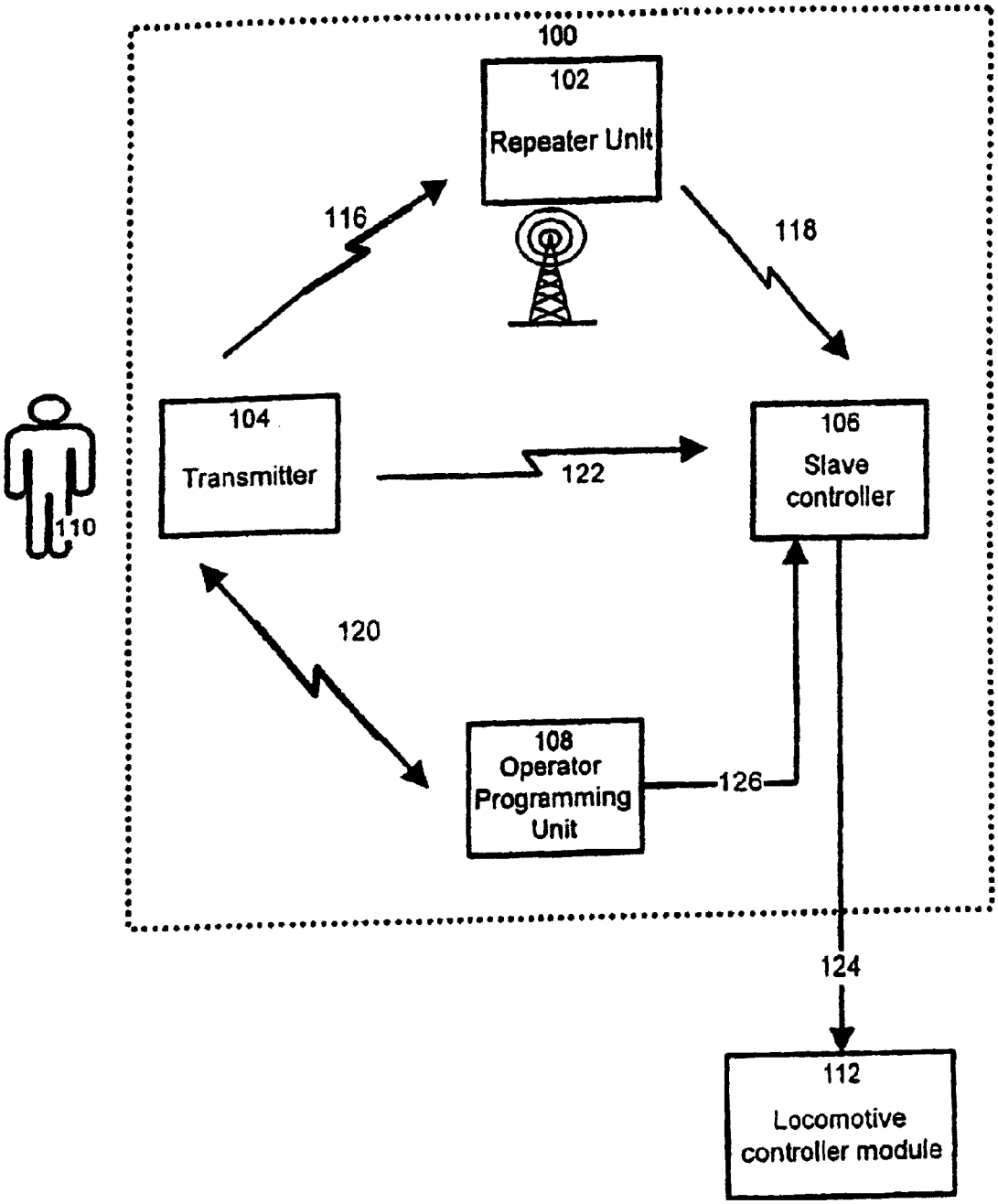
FIG. 1 shows a simplified functional block diagram of a radio communication system including an embodiment of the invention.

In a preferred embodiment of this invention, the method for assigning an address to a communication component is used in a radio control system such as can be used in a locomotive control system. As shown in FIG. 1, the radio control system 100 includes a set of functional units namely a portable transmitter 104 and a slave controller 106 mounted on board the locomotive. The transmitter has an interface allowing an operator 110 to enter commands. Typically, the interface includes a control panel with switches and levers allowing the operator 110 to remotely control the movement of the locomotive. Optionally, the radio control system may also include a repeater unit 102 to increase the effective operational range between the transmitter 104 and the slave controller 106.

The transmitter 104 generates command signals over an RF link 122 (or 116 and 118 if the repeater unit 102 is involved). The slave controller 106 receives the commands and implements them. The implementation procedure consists of generating the proper control signals and interfacing those control signals with main controller module 112 provided in the locomotive to regulate the operation of the engine, braking system and other devices.

The radio control system includes an operator-programming unit 108 (OPP) to program certain functions of transmitter 104 and the slave controller 106. The programming operation between the OPP 108 and the slave controller 106 is effected over a communication channel 126. The programming operation between the OPP 108 and the transmitter 104 is effected over a communication channel 120. The communication channel 120 is a wireless infrared link. Other communication channels are possible. For example the channel 120 between the operator programming unit 108 and the transmitter 104 may be based on RF communication. In a preferred embodiment, the controller module 112 and the OPP 108 communicate with the slave controller 106 via a standard asynchronous serial communication links 126 124 or any other suitable communication link.

The repeater unit 102 is a ground-based unit whose function is to extend the radio frequency (RF) range of the transmitter 104. In a specific example, the signal range is extended by amplifying the signal and filtering noise components. Repeater units are well-known in the art to which this invention pertains and typically comprise an RF antenna, an RF receiver, a decoder/encoder, an RF re-transmitter and any other equipment such as filters, duplexors and others required to receive a signal, process it and retransmit it. Preferably, the repeater unit re-transmits the signal at a frequency different and sufficiently spaced in frequency from the one used by the transmitter 104 such that the two signals can be resolved when the receiver unit 106 receives them.

In a specific example the radio frequencies used are between 806 MHz and 821 MHz (low band) or between 851 MHz and 866 MHz (High band) and frequencies are selected in pairs one from the low band and one from the high band. Any suitable frequency band may be used here without detracting from the spirit of the invention. The transmitter unit 104 operates at a frequency selected from the low band and the repeater unit 102 retransmits at a frequency selected from the high band. Examples of three frequency pairs are 1) 812.5375 MHz and 857.5375 MHz, 2) 812.7875 MHz and 857.7875 MHz, 3) 818.900 MHz and 863.900 MHz.

The slave controller 106 receives and demodulates the RE signal originating from the transmitter 104 or from the repeater unit 102. The signal is then decoded and the validity of the request is verified. The signal is first demodulated and the components of the message are extracted. In a specific example the message contains a command section, a transmitter identifier section and a slave controller identifier. These components are extracted from the message in a known manner. The validity verification on the message then follows. This is a two-step operation. First, the slave controller 106 determines if the transmitter 104 transmitting the message is permitted to issue commands to the slave controller. Second the signal integrity is verified. The first verification step involves a comparison between the tag extracted from the message and the value stored in the memory of the slave controller. In typical locomotive control systems, a single transmitter can issue commands to a given locomotive. Generally, a memory element in the slave controller, such as a register stores an identifier indicative of the transmitter assigned to the locomotive. The identifier is compared to the tag extracted from the message. If both match, the slave controller concludes that the command is legitimate and proceeds with the remaining verification step. In the absence of match, the slave controller rejects the message and takes no action.

During the second verification step, the signal integrity is assessed. The signal is processed by a check sum assessment algorithm or by any other suitable error detection/correction algorithm. If the slave controller 106 finds that the message is indeed intact then the command that it contains is carried into effect.

Figure 2:
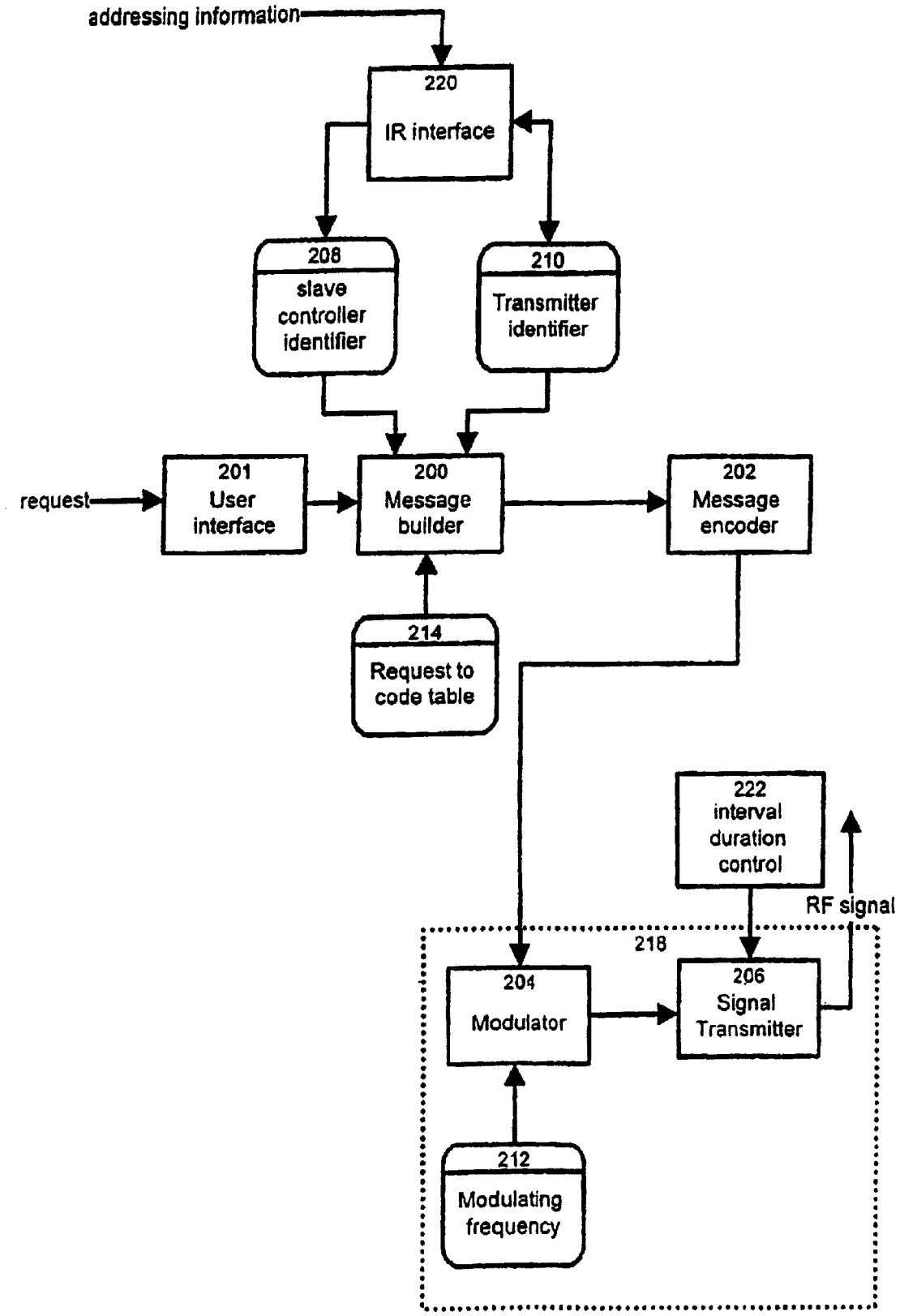
FIG. 2 shows a functional block diagram of a transmitter unit in accordance with the spirit of the invention.

The transmitter 104 of the radio control system is shown in more detail in FIG. 2. The transmitter 104 comprises a set of functional modules namely a user interface 201, a message builder unit 200, a message encoder 202 and a signal transmitting unit 218. The signal transmission unit 218 includes an input for receiving the signal to be transmitted. The signal is supplied to a modulator 204 that modulates the signal and transfers it to a signal transmitter 206 that effects the actual transmission. The modulator is coupled to a modulating frequency generator 212. The signal transmitter 206 is coupled to a time interval duration control module 222. The time interval duration control module 222 stores data for controlling the time interval between two successive transmissions of the signal.

In a typical interaction, the user of the radio control system enters via the user interface 201 a command to be executed by the locomotive. The user interface may be a keyboard, touch screen, speech recognition system or any other suitable input means. In a preferred embodiment, the user interface 201 comprises a set of buttons or levers for each of the allowable actions namely brake, accelerate, reverse and so on. Once the command has been entered the message builder unit 200 processes it. The message builder unit 200 assembles the received command with an identifier for the transmitter as well as for the slave controller. These two identifiers are stored in computer readable storage media 210 and 208. Such computer readable storage media are in the form of a read-only memory (ROM), programmable read-only memory (PROM) modules, EPROM or any other suitable register devices. The command and the identifiers are digitally represented. Many message formats may be used here and the use of a particular message format does not detract from the spirit of the invention.

The transmitter unit includes an infrared interface 220 coupled to the memory units storing the identifiers 208 210. The IR interface receives address information via an IR link. In a specific example, the identifier information is sent by an operator programming unit 108 in the system. In an alternative embodiment, an asynchronous transmission channel (e.g. RS232) can be used instead of the IR interface 220.

Each transmitter is assigned a unique transmission address. In a specific example, the transmission address, herein designated as address, assigned to the transmitter depends on the identifier assigned to the slave controller. The transmitter uses this address in the tag sent along with each message. In a preferred embodiment, the address is a compound data element including the slave controller identifier 208 and the transmitter identifier 210. In a specific example, the identifiers are the serial numbers of the respective components. Since a serial number is generally unique over all components, the address will be unique. Following this, the address is placed on the tag which is added to the message.

Optionally, once the message is created (the command including the tag), an encoding algorithm is applied by the message encoder 202 in order to reduce the occurrence of consecutive 0's or 1's in the message and therefore permit a self-synchronizing communication. Many encoding methods are known in the art of digital signal processing and the use of other encoding methods does not detract from the spirit of the invention.

Once the message has been created, the message is passed to the signal transmission unit 218, in particular to the modulator 204 that modulates the digital signal containing the message at the carrier frequency. In a preferred embodiment, the operator of the radio control unit may select the carrier frequency for the message. The carrier frequency generator 212 outputs the selected carrier frequency. Following the modulation of the signal, a signal transmitter module 206 transmits the signal at predetermined time intervals. The time interval control module 222 controls the time interval between two successive signal transmission events.

The operator programming unit 108 is a module used for performing address synchronization between the transmitter 104 and the slave controller 106. The operator programming unit 108 is used to load the information representative of addresses into the memory of the transmitter 104 and the memory of the slave controller 106 units such as to uniquely define the pair.

Figure 5:
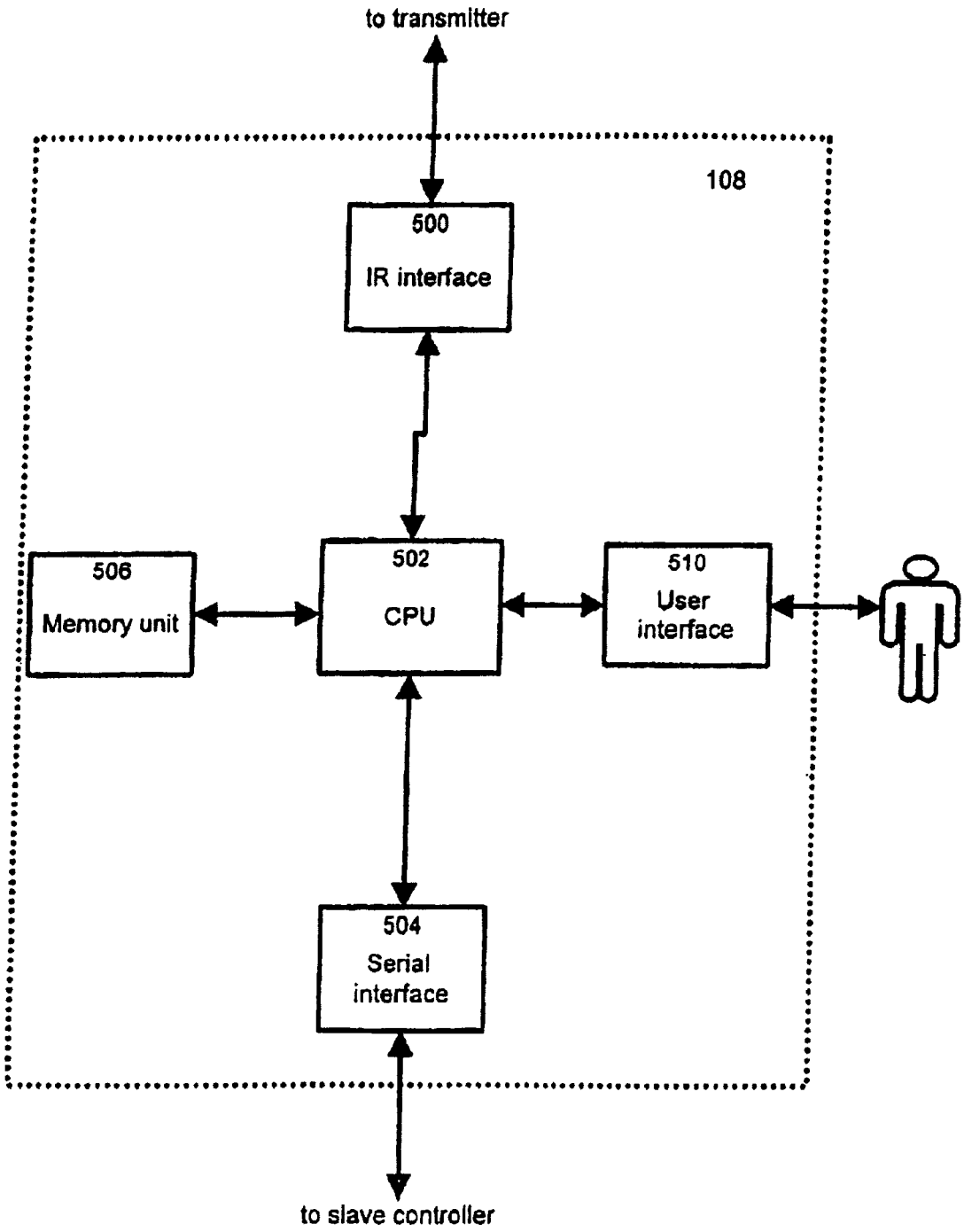
FIG. 5 shows a block diagram of the operator programming unit in accordance with the spirit of the invention.

As best shown in FIG. 5, the operator programming unit comprises a memory unit 506 for storing identifier and programming information, a CPU 502, an IR interface 500, a serial interface 504 and a user interface 510. The CPU 502 interacts with the interfaces and the memory unit to perform functionalities related to programming the transmitter and slave controller devices, as will be discussed later. The IR interface 500 is used to communicate with the transmitter unit via an IR link. The serial interface is used to communicate with the slave controller via a serial communication link. Other interface configurations are possible without departing from the spirit of the invention. For example, both interfaces 500 504 may be IR interfaces or both may be serial interfaces. Furthermore, a single interface may be used to communicate with both the transmitter and the slave controller. Other variations are possible and will be readily apparent to the person skilled in the act.

The user interface 510 is suitable for receiving instructions from an operator to program a given transmitter/slave controller pair.

Figure 3:
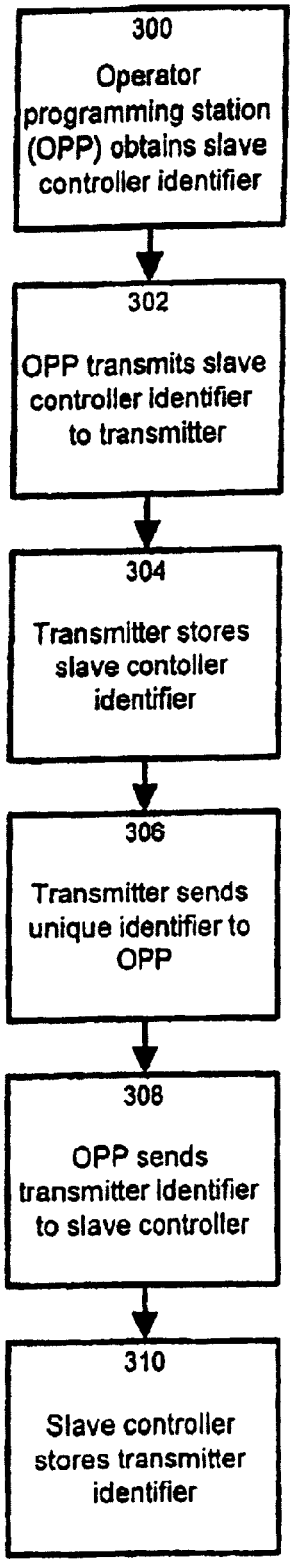
FIG. 3 shows a flow chart of a method in accordance with the invention for assigning a machine address to a transmitter unit.

In a typical interaction, as shown in FIG. 3, at step 300, the operator programming unit 108 obtains the slave controller 106 identifier via a communication channel 126. This is effected by establishing a communication between the operator programming unit 108 and the slave controller 106 over the communication channel 126. During this transaction, the slave controller 106 transmits to the operator programming unit its identifier. The OPP then transmits 302 the slave controller identifier to the transmitter unit 104 via the transmitter's infrared interface 120. The transmitter receives the identifier information and stores it 304 in the appropriate computer readable medium 208. Following this the transmitter sends 306 its unique identifier to the OPP. In a specific example the unique identifier is the transmitter's serial number stored on a computer readable medium 210. The OPP receives the transmitter identifier and transmits it 308 to the slave controller unit. The slave controller unit stores the transmitter's unique identifier on a computer readable medium 310 and the programming is complete. The next time the slave controller receives a message it will check the tag to see if it contains the correct slave controller identifier and the correct transmitter unique identifier.

Figure 4:
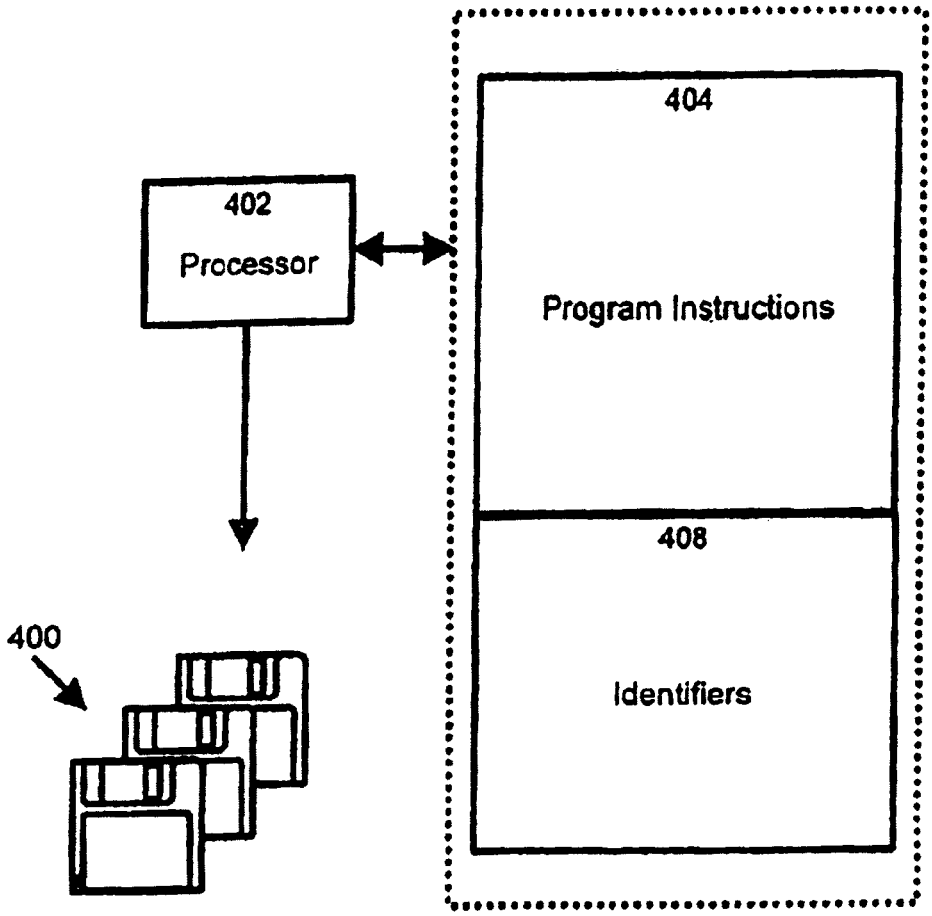
FIG. 4 is a structural block diagram of an apparatus in accordance with the invention for signal transmission in accordance with the invention.

In an alternative embodiment, the transmitter and slave controller identifiers may be randomly generated and sent to the respective components. The operations to generate the identifiers for the components of a communications system may be performed by a general-purpose digital computer using a CPU and memory means as shown in FIG. 4. Such computing platform typically includes a CPU 402 and a memory 400 connected to the CPU by a data communication bus. The memory 400 stores the data 408 and the instructions of the program 404 implementing the functional blocks depicted in the drawing and described in the specification. That program 404 operates on the data 408 in accordance with the algorithms to generate the unique identifiers. Preferably the algorithms operate such that to insure that the identifiers generated are unique. For example, the apparatus may store on a computer readable medium the identifiers assigned thus far in a list, and may scan this list before assigning a new identifier to a component. The addresses are then loaded into PROMs in the transmitter and the receiver.

The steps depicted in FIG. 3 are implemented primarily by software. The program instructions for the software implemented functional blocks are stored in the memory portion 506.

Figure 6:
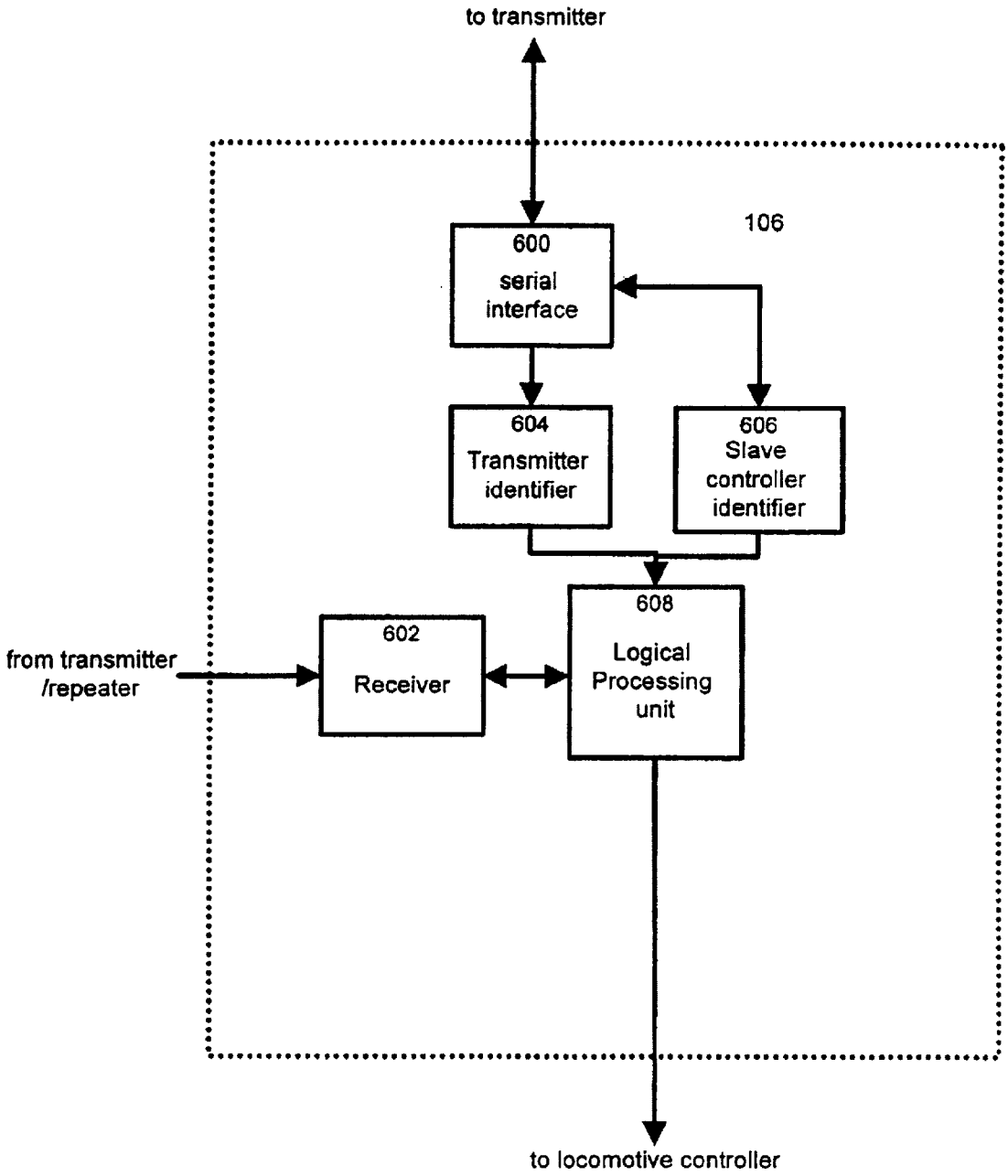
FIG. 6 shows a block diagram of the slave controller unit in accordance with the spirit of the invention.

As to the structure of the slave controller 106, as shown in FIG. 6, the latter comprises a receiver section 602 that senses the signal transmitted by the transmitter 104. The slave controller also comprises an interface 600 for interacting with the operator programming unit. In a specific example the interface 600 is a serial interface. The serial interface 600 is coupled to computer readable storage media 604 606 for storing the identifier of the transmitter unit associated with the slave controller and for storage a slave controller identifier. In addition the slave controller includes a logical processing station 608 to process the received signal and to generate the necessary control signals that are input to the locomotive controller module so the desired command can be implemented. The logical processing station 608 also performs the validation of a message received at the receiver 602.

Although the present invention has been described in considerable detail with reference to certain preferred embodiments thereof, variations and refinements are possible without departing from the spirit of the invention as have been described throughout the document. Therefore, only the appended claims and their equivalents should limit the scope of the invention.

We claim:

1. A transmitter for remotely controlling a locomotive in which is mounted a slave controller, said transmitter comprising:

an interface for receiving an identifier of the slave controller via a first communication link;

a data storage in communication with said interface for storing the identifier of the slave controller received via the first communication link, said data storage being operative to store an identifier of said transmitter;

a message builder in communication with said data storage, said message builder being operative to construct a message having a tag portion and a command portion, the tag portion conveying data derived from the identifier of the slave controller and data derived from the identifier of said transmitter, the command portion conveying at least one command;

a message encoder in communication with said message builder to encode the message constructed by said message builder;

a signal transmitting unit in communication with said message encoder for transmitting a signal containing the encoded message over a second communication link, the second communication link being a wireless RF communication link, the signal being indicative of at least one command for causing an action to be performed by the locomotive.

2. A transmitter as defined in claim 1, wherein said message encoder processes the message constructed by said message builder to reduce an occurrence of consecutive 0's or 1's in the message constructed by said message builder.

3. A transmitter as defined in claim 1, wherein said signal transmitting unit is in communication with said message encoder for receiving the message encoded by said message encoder and for producing the signal conveying the at least one command on the basis of the message encoded by said message encoder.

4. A transmitter as defined in claim 3, wherein said signal transmitting unit includes a modulator for modulating the message encoded by said message encoder to produce the signal conveying the at least one command.

5. A transmitter for remotely controlling a locomotive, said transmitter comprising:

a data storage for holding an identifier of said transmitter and for storing an identifier of a slave controller located on board the locomotive;

an interface in communication with said data storage, said interface being operative to establish a first communication link with an external entity for transmitting to the external entity data derived from the identifier of said transmitter via the first communication link;

a message builder in communication with said data storage, said message builder being operative to construct a message having a tag portion and a command portion, the tag portion conveying data derived from the identifier of the slave controller and data derived from the identifier of said transmitter, a message encoder in communication with said message builder to encode the message constructed by said message builder;

a signal transmitting unit in communication with said message encoder, said signal transmitting unit being operative to transmit a signal containing the encoded message to the slave controller over a second communication link, the second communication link being a wireless RF communication link, the signal conveying:

a) at least one command for causing an action to be performed by the locomotive; and b) data derived from the identifier of said transmitter.

6. A transmitter as defined in claim 5, wherein said signal transmitting unit is in communication with said message encoder for receiving the message encoded by said message encoder and for producing the signal conveying the at least one command on the basis of the message encoded by said message encoder.

7. A transmitter as defined in claim 6, wherein said message encoder processes the message constructed by said message builder to reduce an occurrence of consecutive 0's or 1's in the message constructed by said message builder.

8. A transmitter as defined in claim 6, wherein said signal transmitting unit includes a modulator for modulating the message encoded by said message encoder to produce the signal conveying the at least one command.

9. A transmitter as defined in claim 6, wherein said interface is operative to receive over the first communication link the identifier of the slave controller for storage in said data storage.

10. A slave controller for use in a locomotive having a controller module, said slave controller comprising:

a) an interface for receiving an identifier of a transmitter via a first communication link, the first communication link being a wireless communicaion link;

b) a data storage in communication with said interface, said data storage being suitable for storing the identifier of the transmitter and an identifier of said slave controller;

c) a signal receiver unit for receiving a signal from the transmitter over a second communication link, the second communication link being a wireless RF communication link, the signal conveying a message including a command portion indicative of at least one command for causing an action to be performed by the locomotive, the message also including a tag portion including data derived from the identifier of the transmitter and data derived from the identifier of said slave controller;

d) a logical processing unit in communication with said data storage and with said signal receiver unit, said logical processing unit being operative to:

i) perform a validation procedure on the message including comparing the tag portion in the message with the identifier of the transmitter and the identifier of said slave controller in said data storage;

ii) if the validation procedure validates the message, generate control signals directed to the controller module for causing the locomotive to perform the at least one action.

11. A slave controller as defined in claim 10, wherein said data storage is operative to release the identifier of said slave controller to said interface for transmission over the first communication link.

12. A slave controller as defined in claim 11, wherein the validation procedure includes an assessment of an integrity of the signal conveying a message.

13. A slave controller as defined in claim 12, wherein the assessment of the integrity of the signal conveying a message includes processing the signal conveying the message by an error detection algorithm.

14. A slave controller as defined in claim 12, wherein the assessment of the integrity of the signal conveying a message includes processing the signal conveying a message by an error correction algorithm.

15. A slave controller as defined in claim 10, wherein the at least one action to be performed by the locomotive is acceleration.

16. A slave controller as defined in claim 10, wherein the at least one action to be performed by the locomotive is braking.

17. In combination:

a) a locomotive having a controller module;

b) a slave controller mounted on board the locomotive;

c) said slave controller comprising:

i) an interface for receiving an identifier of a transmitter via a first communication link, the first communication link being a wireless communication link;

ii) a data storage in communication with said interface, said data storage being suitable for storing the identifier of the transmitter and an identifier of said slave controller iii) a signal receiver unit for receiving a signal from the transmitter over a second communication link, the second communication link being a wireless RF communication link, the signal conveying a message including a command portion and a tag portion, the command portion being indicative of at least one command for causing an action to be performed by said locomotive, the tag portion including data derived from the identifier of the transmitter and data derived from the identifier of said slave controller;

iv) a logical processing unit in communication with said data storage and with said signal receiver unit, said logical processing unit being operative to:

(1) perform a validation procedure on the message including comparing data in the tag portion in the message with the identifier of the transmitter and the identifier of said slave controller in said data storage;

(2) if the validation procedure validates the message, generate control signals and directing the control signals to the controller module for causing said locomotive to perform the at least one action.

18. A combination as defined in claim 17, wherein said data storage is operative to release the identifier of said slave controller to said interface for transmission over the first communication link.

19. A combination as defined in claim 17, wherein the validation procedure includes an assessment of an integrity of the signal conveying a message.

20. A combination as defined in claim 19, wherein the assessment of the integrity of the signal conveying a message includes processing the signal conveying a message by an error detection algorithm.

21. A combination as defined in claim 19, wherein the assessment of the integrity of the signal conveying a message includes processing the signal conveying a message by an error correction algorithm.

22. A combination as defined in claim 17, wherein the action to be performed by the locomotive is acceleration.

23. A combination as defined in claim 17, wherein the action to be performed by the locomotive is braking.

24. A remote control system for a locomotive having a controller module, said remote control system comprising:

a) a slave controller for mounting on-board the locomotive;

b) a transmitter for transmitting a wireless signal over a first communication link, said transmitter having an identifier, the first communication link being a wireless RF communication link, the wireless signal conveying at least one command for causing an action to be performed by the locomotive;

c) said slave controller being responsive to the wireless signal to generate control signals for transmission to the controller module to implement the at least one command;

d) said slave controller being operative to output over a second communication link an identifier of said slave controller for transmission to said transmitter; the second communication link;

e) the wireless signal including data derived from the identifier of said slave controller and data derived from the identifier of said transmitter, the identifier of said slave controller being different from the identifier of said transmitter.

25. A remote control system as defined in claim 24, wherein said transmitter includes a data storage for storing the identifier of said slave controller.

26. A remote control system as defined in claim 25, wherein said data storage is adapted to store an identifier of said transmitter.

27. A remote control system as defined in claim 26, wherein said transmitter includes a signal transmitting unit for transmitting the wireless signal over the first communication link.

28. A remote control system as defined in claim 27, wherein said transmitter includes a message builder in communication with said data storage, said message builder being operative to construct a message having a tag portion and a command portion, the tag portion conveying data derived from the identifier of said slave controller and data derived from the identifier of said transmitter, the command portion conveying the at least one command.

29. A remote control system as defined in claim 28, wherein said transmitter has an interface in communication with said data storage for outputting the identifier of said transmitter over a communication link different from said first communication link.

30. A remote control system as defined in claim 29, wherein said interface is operative to receive the identifier of said slave controller and to transmit the identifier of said slave controller to said data storage.

31. A remote control system as defined in claim 30, wherein said interface is an IR interface.

32. A remote control system as defined in claim 31, wherein the at least one action to be performed by the locomotive is acceleration.

33. A remote control system as defined in claim 31, wherein the at least one action to be performed by the locomotive is braking.

34. A remote control system as defined in claim 24, wherein said slave controller includes:

a) a data storage for holding the identifier of said slave controller;

b) an interface in communication with said data storage, said interface operative to output over the second communication link via said interface the identifier of said slave controller.

35. A remote control system as defined in claim 34, wherein said interface is operative to receive over the second communication link an identifier of said transmitter and to direct the identifier of said transmitter to said data storage for storage therein.

36. A remote control system as defined in claim 35, wherein the wireless signal transmitted by said transmitter over the first communication link conveys a message including:

a) a command portion indicative of the at least one command;

b) a tag portion including data derived from the identifier of said transmitter and data derived from the identifier of said slave controller.

37. A remote control system as defined in claim 36, herein said slave controller includes a signal receiver for receiving the wireless signal transmitted by said transmitter over the first communication link.

38. A remote control system as defined in claim 37, wherein said slave controller includes a logical processing unit in communication with said data storage and with said signal receiver unit, said logical processing unit being operative to:

a) perform a validation procedure on the message including comparing data in the tag portion of the message with the identifier of said transmitter and the identifier of said slave controller in said data storage;

b) if the validation procedure validates the message, generate control signals for transmission to the controller module for causing the locomotive to perform the at least one action.

39. A remote control system for a locomotive having a controller module, said remote control system comprising:

a) a slave controller for mounting on-board the locomotive;

b) a transmitter for transmitting a wireless signal over a first communication link, the first communication link being a wireless RF communication link, the wireless signal being indicative of at least one command for causing an action to be performed by the locomotive;

c) said slave controller being responsive to the wireless signal to generate control signals for transmission to the controller module to implement the at least one command;

d) said slave controller being operative to receive over a second communication link, different from the first communication link, an identifier of said transmitter;

e) said slave controller being operative to output over the second communication link an identifier of said slave controller for transmission to said transmitter;

f) the wireless signal including data derived from the identifier of said transmitter.

40. A remote control system as defined in claim 39, wherein said transmitter includes a data storage for storing the identifier of said slave controller.

41. A remote control system as defined in claim 40, wherein said data storage is operative to store the identifier of said transmitter.

42. A remote control system as defined in claim 41, wherein said transmitter includes a signal transmitting unit for transmitting the wireless signal over the first communication link.

43. A remote control system as defined in claim 42, wherein said transmitter includes a message builder in communication with said data storage, said message builder operative to construct a message having a tag portion and a command portion, the tag portion conveying data derived from the identifier of said slave controller and data derived from the identifier of said transmitter, the command portion conveying the at least one command.

44. A remote control system as defined in claim 43, wherein said transmitter has an interface in communication with said data storage for outputting the identifier of said transmitter over a communication link different from said first communication link.

45. A remote control system as defined in claim 44, wherein said interface is operative to receive the identifier of said slave controller and to transmit the identifier of said slave controller to said data storage for storage therein.

46. A remote control system as defined in claim 45, wherein said interface is an IR interface.

47. A remote control system as defined in claim 43, wherein the at least one action to be performed by the locomotive is acceleration.

48. A remote control system as defined in claim 43, wherein the at least one action to be performed by the locomotive is braking.

49. A remote control system as defined in claim 39, wherein said slave controller includes:

a) a data storage for holding the identifier of said slave controller;

b) an interface in communication with said data storage, said interface operative to output over the second communication link via said interface the identifier of said slave controller.

50. A remote control system as defined in claim 49, wherein said interface is operative to receive over the second communication link the identifier of said transmitter and to direct the identifier of said transmitter to said data storage for storage therein.

51. A remote control system as defined in claim 50, wherein the wireless signal transmitted by said transmitter over the first communication link conveys a message including:

a) a command portion indicative of the at least one command;

b) a tag portion including data derived from the identifier of said transmitter and data derived from the identifier of said slave controller.

52. A remote control system as defined in claim 51, wherein said slave controller includes a signal receiver for receiving the wireless signal transmitted by said transmitter over the first communication link.

53. A remote control system as defined in claim 52, wherein said slave controller includes a logical processing unit in communication with said data storage and with said signal receiver unit, said logical processing unit being operative to:

a) perform a validation procedure on the message including comparing data in the tag portion in the message with the identifier of said transmitter and the identifier of said slave controller in the data storage;

b) if the validation procedure validates the message generating control signals for transmission to the controller module for causing the locomotive to perform the at least one action.

54. A method for remotely controlling a locomotive in which is mounted a slave controller, said method comprising:

a) providing a portable transmitter;

b) communicating to the portable transmitter an identifier of the slave controller over a first communication link;

c) storing in a data storage in said portable transmitter the identifier of the portable transmitter and the identifier of the slave controller communicated over the first communication link;

d) outputting from the portable transmitter over the first communication link the identifier of the portable transmitter for transmission to the slave controller;

e) transmitting to the slave controller a wireless signal over a second communication link different from the first communication link, the second communication link being a wireless RF communication link, the wireless signal conveys a message including:

i) a command portion indicative of at least one command for causing an action to be performed by the locomotive;

ii) a tag portion including the data derived from the identifier of the portable transmitter stored in the data storage and data derived from the identifier of the slave controller stored in the data storage.

55. A method as defined in claim 54, wherein the first communication link is an IR link.

56. A method for remotely controlling a locomotive in which is provided a controller module, comprising:

a) mounting on board the locomotive a slave controller;

b) interfacing the slave controller with the controller module;

c) communicating to the slave controller over a first communication link an identifier of a remote portable transmitter;

d) storing in a data storage in the slave controller the identifier of the remote portable transmitter;

e) transmitting from the remote portable transmitter a wireless signal over a second communication link distinct from the first communication link, the second communication link being a wireless RF communication link, the wireless signal conveying a message including:

i) a command portion indicative of at least one command for causing an action to be performed by the locomotive; and ii) a tag portion;

f) receiving the wireless signal at the slave controller;

g) performing a validation procedure at the slave controller by comparing data in the tag portion of the message in the received wireless signal with the identifier of the remote portable transmitter in the data storage and an identifier of the slave controller;

h) if the validation procedure validates the message in the received wireless signal, generating control signals and directing the control signals to the controller module for causing the locomotive to perform the at least one action.

57. A device for synchronizing addresses in a communication control system, the communication control system including a slave controller having a first component having a memory storing a first identifier and a transmitter unit for remotely controlling a locomotive in which is mounted the slave controller, the transmitter unit having a memory storing a second identifier, said device comprising:

a) a port for establishing a communication link with the slave controller and for establishing a communication link with the transmitter unit, the communication link with one of the slave controller and the transmitter unit being a wireless communication link;

b) a memory unit;

c) a processing unit operatively coupled to said port and said memory unit, said processing unit being suitable for:

i) establishing a communication link through said port with the slave controller for acquiring the first identifier from the slave controller;

ii) storing the first identifier in said memory unit;

iii) establishing a communication link through said port with the transmitter unit for transmitting the first identifier stored in said memory unit to the transmitter unit.

58. A device as defined in claim 57, wherein said port has a first interface for communication with the slave controller and a second interface for communication with the transmitter unit.

59. A device as defined in claim 58, wherein at least one of said first interface and said second interface is an infrared interface.

60. A device as defined in claim 58, wherein at least one of said first interface and said second interface is a serial connection interface.

61. A device as defined in claim 57, wherein said processing unit is further suitable for:

a) establishing a communication link with a transmitter unit for acquiring the second identifier from the transmitter unit;

b) storing the second identifier in said memory unit;

c) establishing a communication link with the slave controller for transmitting the second identifier stored in said memory unit to the slave controller.

62. A method for synchronizing addresses in a communication control system, the communication control system having a first component associated to a first identifier, a second component associated to a second identifier and an operator programming unit, said method comprising:

i) establishing a communication link between the operator programming unit and the first component for transmitting the first identifier from the first component to the operator programming unit;

ii) establishing a communication link between the operator programming unit and the second component for transmitting the first identifier from the operator programming unit to the second component;

iii) generating an address at the second component on the basis of the first identifier and the second identifier, wherein the first identifier and the second identifier are different.

63. A device as defined in claim 62, wherein the first component is a slave controller module and the second component is a transmitter unit.

64. A device as defined in claim 62, wherein the first component is a transmitter unit and the second component is a slave controller module.

65. A method as defined in claim 62, wherein said wireless communication link is an infrared communication link.

66. A method as defined in claim 62, wherein the communication link between the operator programming unit and at least one of the first component and the second component is a wireless communication link.

67. A method as defined in claim 62, wherein said method further comprises:

i) establishing a communication link with the second component for acquiring the second identifier from the second component;

ii) establishing a communication link with the first component for transmitting the second identifier to the first component;

iii) generating an address at the first component on the basis of the second identifier and the first identifier.

68. A computer readable storage medium including a program element suitable for execution by a computing apparatus for synchronizing addresses in a communication control system, the communication control system having a first component associated to a first identifier and a second component associated to a second identifier, the computing apparatus comprising:

a) a memory unit;

b) a processing unit for executing said program element, said processing unit in an operative relationship with said memory unit, when said program element is executed by said processing unit, said program element causing:

i) establishing a communication link between the computing apparatus and the first component for acquiring the first identifier from the first component;

ii) storage of the first identifier in said memory unit;

iii) establishing a communication link between the computing apparatus and the second component for transmitting the first identifier stored in said memory unit to the second component, the communication link between the computing apparatus and one of the first and second components being in a wireless communication link;

iv) establishment of a communication link between the computing apparatus and the second component for acquiring the second identifier from the second component;

v) storing of the second identifier in said memory unit;

vi) establishment of a communication link between the computing apparatus and the first component for transmitting the second identifier stored in said memory unit to the first component.

69. A computer readable storage medium as defined in claim 68, wherein the first component is a slave controller module for controlling a locomotive and the second component is a transmitter unit.

70. A computer readable storage medium as defined in claim 68, wherein the first component is a transmitter unit and the second component is a slave controller module for controlling a locomotive.

71. A computer readable storage medium as defined in claim 68, wherein the wireless communication link is an infrared communication link.

72. A communication control system comprising:

a) a first component having a memory storing a first identifier;

b) a second component having a memory storing a second identifier, the second identifier being different from said first identifier;

c) a device for synchronizing addresses between said first component and said second component, said device comprising:

i) a port for establishing a communication link with said first component and a communication link with said second component;

ii) a memory unit;

iii) a processing unit operatively coupled to said port and said memory unit, said processing unit being suitable for:

(1) establishing a communication link through said port with said first component for acquiring the first identifier from the first component;

(2) storing the first identifier in said memory unit;

(3) establishing a communication link through said port with said second component for transmitting the first identifier stored in said memory unit to said second component, such as to allow said second component to hold the first identifier and the second identifier in a storage unit at said second component;

d) said second component being operative for generating an address on the basis of the first identifier and the second identifier, wherein the communication link with one of said first component and said second component is a wireless communication link.

73. A control system as defined in claim 72, wherein said first component is a slave controller module for a locomotive and said second component is a transmitter unit.

74. A control system as defined in claim 72, wherein said first component is a transmitter unit and said second component is a slave controller module for a locomotive.

75. A control system as defined in claim 72, wherein said port has a first interface for communication with said first component and a second interface for communication with said second component.

76. A control system as defined in claim 75, wherein at least one of said first interface and said second interface is an infrared interface.

77. A control system as defined in claim 72, wherein said processing unit is further suitable for:

i) establishing a communication link through the port with the second component for acquiring the second identifier from the second component;

ii) storing the second identifier in said memory unit;

iii) establishing a communication link through the port with the first component for transmitting the second identifier stored in said memory unit to the first component, thereby allowing the first component to hold the first identifier and the second identifier in a storage unit at the first component.

78. A transmitter for remotely controlling a locomotive, said transmitter comprising:

a) a data storage for holding an identifier of said transmitter;

b) an interface in communication with said data storage, said interface being oprative to establish a first communication link with an external entity for transmitting to the external entity data derived from the identifier of said transmitter via the first communication link, said first communication link being a wireless communication link;

c) a signal transmitting unit in communication with said data storage, said signal transmitting unit being operative to transmit a moculated signal over a second communication link, the second communication link being a wireless RF communication link, the modulated signal conveying:

i) at least one command for causing an action to be performed by the locomotive; and ii) data derived from the identifier of said transmitter;

d) said signal transmitting unit including a modulator releasing the modulated signal.

79. A transmitter as defined in claim 78, wherein said signal transmitting unit is operative to transmit the modulated signal to a slave controller mounted on board the locomotive, said data storage being operative to store an identifier of the slave controller.

80. A transmitter as defined in claim 79, wherein said transmitter further comprises a message builder in communication with said data storage, said message builder being operative to construct a message having a tag portion and a command portion, the tag portion conveying data derived from the identifier of the slave controller and data derived from the identifier of said transmitter, the command portion conveying the at least one command.

81. A transmitter as defined in claim 80, including a message encoder in communication with said message builder to encode the message constructed by said message builder.

82. A transmitter as defined in claim 81, wherein said signal transmitting unit is in communication with said message encoder for receiving the message encoded by said message encoder and for producing the modulated signal conveying the at least one command on the basis of the message encoded by said message encoder.

83. A transmitter as defined in claim 81, wherein said message encoder processes the message constructed by said message builder to reduce an occurrence of consecutive 0's or 1's in the message constructed by said message builder.

84. A transmitter as defined in claim 82, wherein said modulator modulates the message encoded by said message encoder to produce the modulated signal conveying the at least one command.

85. A transmitter as defined in claim 78, wherein said interface is operative to receive over the first communication link the identifier of the slave controller for storage in said data storage.

86. A transmitter as defined in claim 78, wherein the first communication link is an IR communication link.

87. A transmitter as defined in claim 78, wherein the action to be performed by the locomotive is acceleration.

88. A transmitter as defined in claim 78, wherein the action to be performed by the locomotive is braking.

89. A transmitter as defined in claim 3, wherein the at least one command includes command information derived from the command portion of the message.

90. A transmitter as defined in claim 6, wherein the at least one command includes command information derived from the command portion of the message.

91. A transmitter as defined in claim 1, wherein the first communication link is an IR communication link.

92. A transmitter as defined in claim 5, wherein the first communication link is an IR communication link.

93. A slave controller as defined in claim 10, wherein the first communication link is an IR communication link.

94. A combination as defined in claim 19, wherein the first communication link is an IR communication link.

* * * * *